US009546524B2

(12) United States Patent
Drenth et al.

(10) Patent No.: US 9,546,524 B2
(45) Date of Patent: Jan. 17, 2017

(54) HANDLING AND RECOVERY DEVICES FOR TUBULAR MEMBERS AND ASSOCIATED METHODS

(71) Applicant: Longyear TM, Inc., South Jordan, UT (US)

(72) Inventors: Christopher L. Drenth, Burlington, CA (US); Jeff Hogan, Brampton, CA (US); Anthony LaChance, Mississauga, CA (US)

(73) Assignee: Longyear TM, Inc., Salt Lake City, UT (US)

( * ) Notice: Subject to any disclaimer, the term of this patent is extended or adjusted under 35 U.S.C. 154(b) by 464 days.

(21) Appl. No.: 14/192,569

(22) Filed: Feb. 27, 2014

(65) Prior Publication Data

US 2015/0184471 A1 Jul. 2, 2015

Related U.S. Application Data

(60) Provisional application No. 61/922,323, filed on Dec. 31, 2013.

(51) Int. Cl.
*E21B 19/06* (2006.01)
*E21B 31/12* (2006.01)
*E21B 21/02* (2006.01)

(52) U.S. Cl.
CPC ..... *E21B 19/06* (2013.01); *E21B 21/02* (2013.01); *E21B 31/12* (2013.01)

(58) Field of Classification Search
CPC ..... E21B 19/06; E21B 31/18; E21B 31/20
See application file for complete search history.

(56) References Cited

U.S. PATENT DOCUMENTS 2,182,797 A * 12/1939 Dillon ..... F16L 37/092 277/500
5,967,477 A * 10/1999 Walmsley ..... E21B 19/06 248/230.2
7,198,311 B1 * 4/2007 Potts ..... E21B 19/06 294/86.24
7,552,764 B2 * 6/2009 Weems ..... B66C 1/42 166/75.14
7,744,140 B2 * 6/2010 Rowley ..... F16B 7/025 294/94
7,854,266 B2 * 12/2010 Watson ..... E21B 17/06 166/242.6

(Continued)

OTHER PUBLICATIONS

PCT/US2014/072084, filed Dec. 23, 2014, Drenth et al.

(Continued)

*Primary Examiner* — Emmanuel M Marcelo
(74) *Attorney, Agent, or Firm* — Ballard Spahr LLP

(57) ABSTRACT

Implementations described herein include a hoisting device and method for handling, coupling and recovery of tubular members such as drill string components. The hoisting device has a self-energizing gripping means configured to releasably engage a drill string component. In one aspect, the self-energizing gripping means can be operable to increase at least one of a radial biasing force and a contact friction force applied to a drill string component, causing the gripping means to increase the overall gripping force applied to the component with minimal effort exerted by a hoisting device operator.

30 Claims, 5 Drawing Sheets

(56) References Cited

U.S. PATENT DOCUMENTS

| | | | | |
|---|---|---|---|---|
| 8,186,246 | B2 * | 5/2012 | Niven | B25B 13/462 166/77.51 |
| 8,720,541 | B2 * | 5/2014 | Ellis | E21B 19/07 166/380 |
| 9,163,651 | B2 * | 10/2015 | Ostrobrod | A62B 35/0068 |
| 2003/0000742 | A1 | 1/2003 | Juhasz et al. | |
| 2007/0261857 | A1 * | 11/2007 | Kuttel | E21B 19/06 166/380 |
| 2009/0095489 | A1 * | 4/2009 | Roodenburg | E21B 21/106 166/381 |
| 2009/0321064 | A1 | 12/2009 | Ellis et al. | |
| 2013/0292136 | A1 * | 11/2013 | McIntosh | E21B 19/06 166/381 |
| 2014/0090856 | A1 * | 4/2014 | Pratt | E21B 19/16 166/380 |
| 2015/0122490 | A1 * | 5/2015 | Greening | E21B 21/08 166/250.01 |
| 2015/0247367 | A1 * | 9/2015 | Angelle | E21B 19/07 166/380 |

OTHER PUBLICATIONS

Written Opinion of the International Searching Authority mailed on Apr. 1, 2015 for application PCT/US2014/072084, filed on Dec. 23, 2014 (Applicant—Longyear, Inc. // Inventor—Drenth, et al.) (11 pages).

International Search Report from the International Searching Authority mailed on Apr. 1, 2015 for application PCT/US2014/072084, filed on Dec. 23, 2014 (Applicant—Longyear, Inc. // Inventor—Drenth, et al.) (5 pages).

* cited by examiner

HANDLING AND RECOVERY DEVICES FOR TUBULAR MEMBERS AND ASSOCIATED METHODS

CROSS REFERENCE TO RELATED APPLICATIONS

This application claims priority to U.S. Provisional Application No. 61/922,323, filed Dec. 31, 2013. The disclosure of the above-referenced application is hereby incorporated herein by reference in its entirety.

BACKGROUND

The Field of the Invention

Implementations described herein relate generally to handling, coupling, and recovery devices for tubular members. In particular, implementations described herein relate to handling, coupling, and recovery devices for tubular members comprising a self-energizing gripping means.

Background

Oilfield, exploration, and other drilling technologies make extensive use of tubular members. For example, the process of drilling often involves handling, lifting, manipulating and otherwise using numerous pipes or rods that may be connected together to form a drill string, drill rod, fluid conduit, borehole casing, or other passageway. To move the pipes or other components into location, they are typically handled and lifted manually, by a machine, or a combination of the foregoing. In the case of manual lifting, for example and without limitation, the hoisting device can have a handle or the like for a user to grasp. In the case of machine lifting, for example and without limitation, the hoisting device can further comprise at least one of a threaded joint to mate with a threaded tubular member, a non-threaded flexible cable connection that can facilitate extended range machine lifting, or a drilling fluid supply connection having a bearing swivel configured for high-speed drilling rotation to support loads due to the hoisting device itself as well as the tubular members during addition or subtraction from the drill string, and the like.

Machine facilitated lifting can occur either at the surface to add or subtract tubular members from a drill string or deep within a hole to recover lost tubular members. When machine facilitated lifting is uses to recover a tubular member from within a hole, pipe handling and recovery devices commonly employ threaded recovery taps. Threaded recovery taps can engage a threaded component by tapping or threading into the threaded section of the component. However, the tapping operation can be difficult and unreliable. In one instance, the gripping capability of the threaded recovery taps can depend on how many turns of thread tap into the broken rod and, additionally or alternatively, on the tap thread cutting depth. In another instance, the tap thread can be unable to accommodate tolerance extremes that may be present on drill rod inner diameters or worn outer diameters. In drilling applications, drill rod wear against the drill hole can be significant. In yet another instance, the threaded recovery tap connection can be unable to accommodate the change in component dimensions that can occur as a result of load response during pullback experienced during recovery operations.

Additionally, in some cases a pipe or other component may have been precision manufactured to satisfy very tight tolerances, to ensure optimal fatigue strength, a leak-free seal or the like. Consequently, the introduction of even very small impurities into or creating defects in the pipe or pipe threads may have detrimental effects to the threaded connection of a pipe, the contents carried within the pipe, and the like. An operator that places his or hand inside or on the pipe may introduce impurities from the operator's hand or glove, and such impurities can be undesirable for certain applications.

Accordingly, a need exists for improved handling and recovery devices for tubular members that provide reliable gripping regardless of operator position or applied lift and that reduces or eliminates damage to tubular members during the handling and/or recovery operation.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

One or more implementations described herein overcome one or more of the foregoing or other problems in the art with handling, coupling and recovery of tubular members commonly used in oilfield, drilling and exploration industries such as, for example and without limitation, drill string components.

In one aspect, one or more implementations of a hoisting device comprise a housing and a self-energizing gripping means operable to releasably engage a drill string component.

In another aspect, one or more implementations of a self-energizing gripping means can be operable to increase at least one of a radial biasing force and a contact friction force applied to a drill string component, causing the gripping means to increase the overall gripping force applied to the component with minimal effort exerted by a hoisting device operator.

In another aspect, one or more implementations of a self-energizing gripping means comprises at least one polar array of cam gripper elements rotationally coupled to the surface of the housing and in cooperative communication with gripper element openings defined in the housing in order to releasably engage a tubular member.

In another aspect, one or more implementations of a self-energizing gripping means comprises a housing having at least one polar array of roller gripper elements positioned movably against a corresponding wedge surface by a biased cage element in order to releasably engage a tubular member.

In addition to the foregoing, an implementation of a method comprising at least one of handling, coupling and recovering a tubular member involves engaging a tubular member in an operative end of a recovery device such that a self-energizing gripping means actuates to allow a desired axial length of the tubular member to be engaged and, when the hoisting device is retracted, actuates in an opposite manner to secure the tubular member with a gripping force.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION

The accompanying drawings, which are incorporated in and constitute a part of this specification, illustrate aspects and together with the description, serve to explain the principles of the methods and systems.

DETAILED DESCRIPTION

Figure 1:
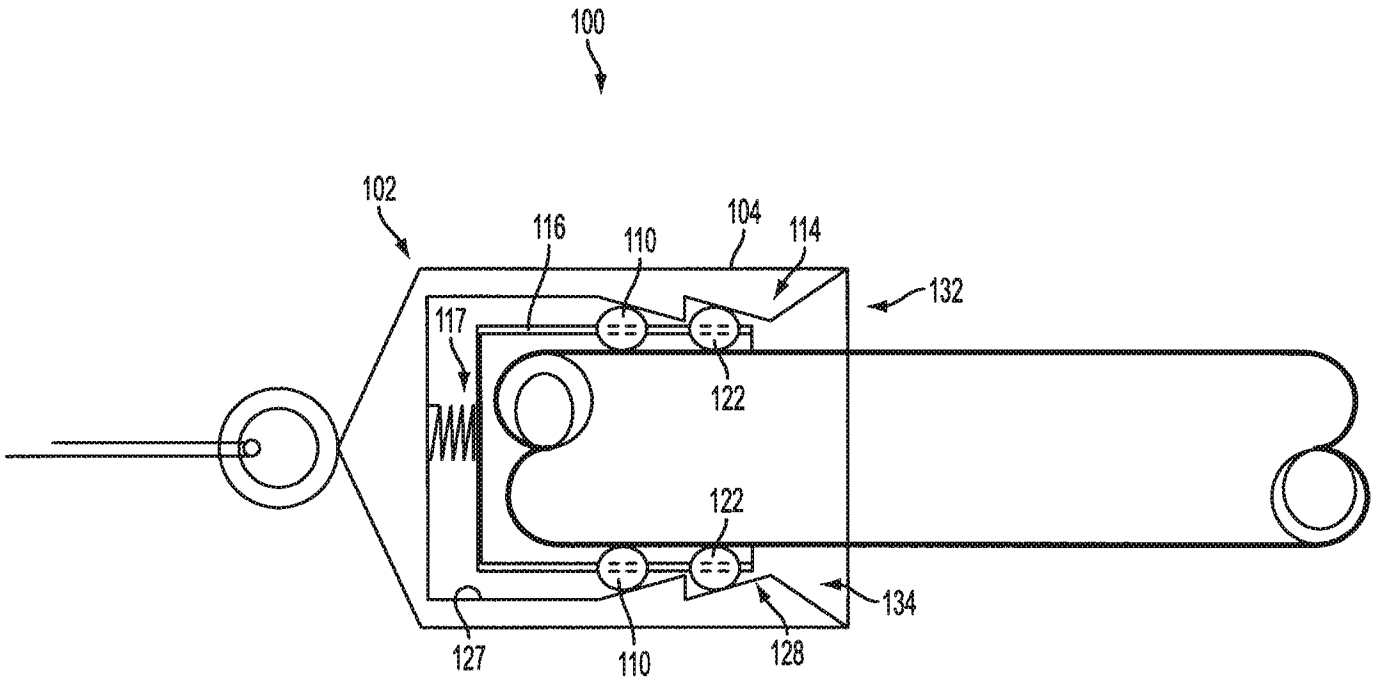
FIG. 1 illustrates a longitudinal cross-sectional view of one example of an aspect of a recovery device configured to engage an outer diameter of a tubular member.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. To this end, those skilled in the relevant art will recognize and appreciate that many changes can be made to the various aspects of the invention described herein, while still obtaining the beneficial results described herein. It will also be apparent that some of the desired benefits described herein can be obtained by selecting some of the features described herein without utilizing other features. Accordingly, those who work in the art will recognize that many modifications and adaptations to the present invention are possible and can even be desirable in certain circumstances and are a part described herein. Thus, the following description is provided as illustrative of the principles described herein and not in limitation thereof.

Reference will be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects of handling and recovery of drill string components have not been described in particular detail in order to avoid unnecessarily obscuring aspects of the disclosed implementations.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal aspect. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be predefined it is understood that each of these additional steps can be predefined with any specific aspect or combination of aspects of the disclosed methods.

Implementations described herein are directed toward components, devices, and systems that provide for effective handling, coupling and recovery of tubular members such as, for example and without limitation, those used in oilfield, exploration and other drilling technologies. For example, implementations described herein comprise handling, coupling and recovery devices for drill string components. In certain aspects, the hoisting devices can improve gripping capability over conventional gripping modalities. In particular, one or more implementations comprise hoisting devices having a self-energizing gripping means configured to engage a tubular component. In one or more aspects, the self-energizing gripping means can comprise an assembly that can have at least one pair of polar roller gripper elements positioned movably against at least a portion of at least one corresponding circumferential wedge surface and in cooperative communication with a cage member that can be biased relative to the housing. Additionally or alternatively, the hoisting devices can be configured to accommodate dimensional changes in the component due to wear and/or loading conditions. Such hoisting devices can reduce or eliminate damage due to slipping, dropping or otherwise mishandling a component over conventional hoisting devices.

Reference will now be made to the drawings to describe various aspects of one or more implementations of the invention. It is to be understood that the drawings are diagrammatic and schematic representations of one or more implementations, and are not limiting of the present disclosure. Moreover, while various drawings are provided at a scale that is considered functional for one or more implementations, the drawings are not necessarily drawn to scale for all contemplated implementations. The drawings thus represent an exemplary scale, but no inference should be drawn from the drawings as to any required scale.

In the following description, numerous specific details are set forth in order to provide a thorough understanding described herein. It will be obvious, however, to one skilled in the art that the present disclosure may be practiced without these specific details. In other instances, well-known aspects of in-field equipment for handling, coupling and recovering tubular members such as, for example and without limitation, drill string components and the like have not been described in particular detail in order to avoid unnecessarily obscuring aspects of the disclosed implementations.

Figure 2:
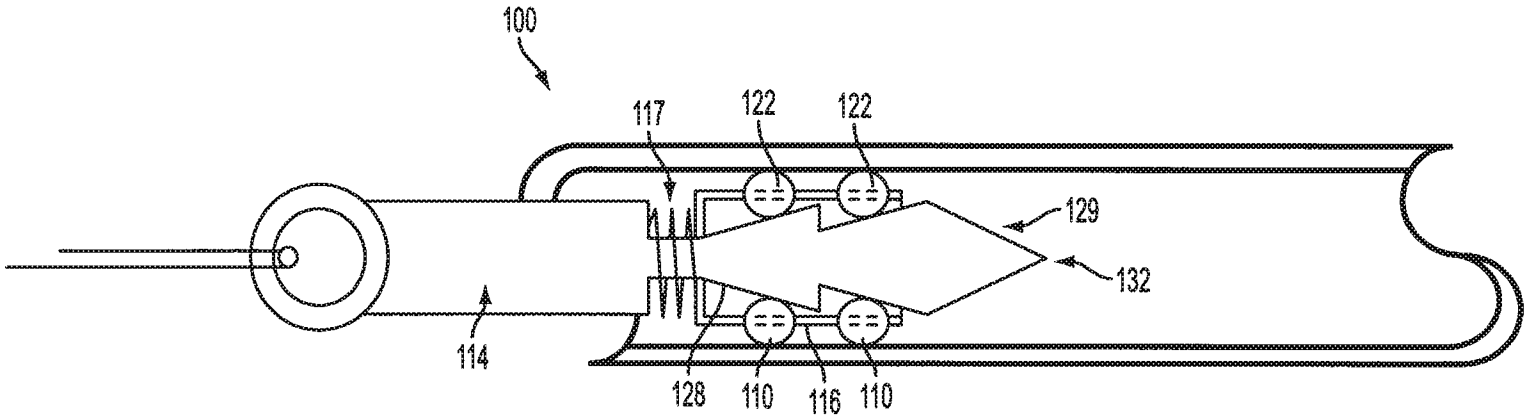
FIG. 2 illustrates a longitudinal cross-sectional view of one example of an aspect of a recovery device configured to engage an inner diameter of a tubular member.

Turning now to FIG. 1, an implementation of one exemplary aspect of a hoisting device 100 for drill string components is illustrated. The hoisting device 100 comprises a housing 102 and a self-energizing gripping means 104 operable to releasably engage a drill string component. Self-energizing gripping means described herein can have a natural "self-applying" characteristic. In one aspect, a self-energizing gripping means can be operable to increase at least one of a radial biasing force and a contact friction force applied to a drill string component, causing the gripping means to increase the overall gripping force applied to the component with minimal effort exerted by a hoisting device operator. A self-energizing gripping means can comprise at least one polar array 104 of roller gripper elements 122 positioned movably against at least one wedge surface 128 in a housing 102 as illustrated in FIGS. 1-2.

In various aspects, the roller gripper housing 102 can comprise a cage member 116 having a plurality of roller gripper element openings 110 defined therein and the base member 114 can have an elongate length extending between a proximal and a distal end, wherein at least a portion of the exterior surface defines at least one wedge surface 128 that tapers inwardly as the wedge surface moves toward the distal end of the base member. Here, at least one polar array of roller gripper elements 122 can be disposed in cooperative communication with the plurality of roller gripper element openings 110 and at least a portion of the at least one wedge surface 128. In some aspects, the housing 102 can be biased. Here, the cage member 116 can have a proximal end and a biasing member 117 can be disposed between the proximal end of the cage member and the base member 114. In further aspects, the biasing member 117 can be, for example and without limitation, a spring or the like.

In a further aspect, the hoisting device 100 can comprise at least one polar array 104 of roller gripping elements 122 that are positioned axially within the cage member 116 in cooperative communication with roller gripper element openings 110 and, in this aspect, it is also contemplated that the at least one polar array of roller gripper elements can be positioned moveably against at least a portion of at least one wedge surface 128. In one aspect, the housing 102 can be configured to maintain the polar array 104 of roller gripper elements 122 at an axial position corresponding to maximum radial displacement along the respective wedge surface 128 when the hoisting device 100 is in an unloaded state. In one aspect, in an unloaded position, the radial distance across opposing rollers extending through the roller gripper openings 110 is configured such that a drill string component of a given diameter could not pass over or in between the roller gripper elements, depending on whether the hoisting device is configured to engage the inner or outer surface of the drill string component.

In operation, as the hoisting device 100 axially engages the drill string component, the roller gripper elements 122 are urged axially and radially down the respective wedge surface 128. After the hoisting device engages a desired axial length of the drill string component, the base member 114 can move relative to the biased cage member 116 in a second axial direction that can be substantially the reverse of the axial engagement direction, urging the roller gripper elements 122 up the respective wedge surface 128 to an engagement position in which the hoisting device will create a secure gripping force on the drill string component and enable handling thereof.

In one aspect shown in FIG. 1, the hoisting device 100 can be configured to engage an outer diameter of a drill string component. Here, the base member 114 is further configured to have a substantially cylindrical cavity 134 defined therein and further comprises an inner surface 127 that extends the axial length of that cavity. The base member 114 can further comprise at least one wedge surface 128 defined along at least a portion of the axial length of the inner surface 127 of the base member 114. The cylindrical cage member 116 can be configured to have a diameter less than the smallest internal diameter of the internal surface 127 of the base member 114. In this aspect, at least one polar array 104 of roller gripper elements 122 can be defined between the outer surface of the cylindrical housing 102 and the inner surface 127 of the base member 114. The at least one polar array 104 of roller gripper elements 122 can be placed in communication with the gripper element openings 110 of the cage member 116 and the at least one wedge surface 128 of the base member 114. The biasing member 117 can maintain the polar array 104 of roller gripper elements 122 at an axial position corresponding to maximum radial displacement relative to the housing 102 along the at least one wedge surface 128 of the base member 114 when the hoisting device 100 is in an unloaded state. Thus, the distance between opposing roller gripper elements 122 in the at least one polar array are configured to be less than the outer diameter of the drill string component to be engaged by the hoisting device 100 in an unloaded state. In operation, as the hoisting device 100 is inserted into a drill string component, the roller gripper elements 122 can be urged axially and radially outward due to the translation of the roller gripper elements 122 down the wedge surface 128. In one aspect, generally the only resistance to this action is the force of the biased cage member 116. As one skilled in the art will appreciate, after the hoisting device 100 engages a desirable axial length of the drill string component, the hoisting device 100 can be retracted, urging the roller gripper elements 122 axially and radially inward as they translate up the wedge surface 128.

Optionally, in another aspect shown in FIG. 2, the hoisting device 100 can be configured to engage an inside diameter of a drilling component. Here, the base member 114 has an exterior surface 129 and an elongate length extending between a proximal and a distal end, wherein at least a portion of the exterior surface defines at least one wedge surface 128 that tapers inwardly as the wedge surface moves toward the distal end of the base member. The cage member 116 can have a plurality of roller gripper element openings defined therein and can be configured to have a diameter greater than the largest external diameter of the base member 114. In this aspect, at least one polar array of roller gripper elements 122 can be disposed between an inner surface of the cage member 116 and the outer surface 129 of the base member 114. The at least one polar array 104 of roller gripper elements 122 can be placed in cooperative communication with the roller gripper element openings 110 and at least a portion of the at least one wedge surface 128. The biasing member 117 can maintain the polar array 104 of roller gripper elements 122 at an axial position corresponding to maximum radial displacement along the at least one wedge surface 128 of the base member 114 relative to the central axis of the base member 114 when the hoisting device 100 is in an unloaded state. Thus, the distance between opposing roller gripper elements 122 in the at least one polar array are configured to be greater than the inner diameter of the drill string component to be engaged by the hoisting device 100 in an unloaded state. In operation, as the hoisting device 100 is inserted into a drill string component, the roller gripper elements 122 can be urged axially and radially inward due to the translation of the roller gripper elements 122 down the wedge surface 128. In one aspect, generally the only resistance to this action is the force of the biased cage member 116. As one skilled in the art will appreciate, after the hoisting device 100 engages a desirable axial length of the drill string component, the hoisting device 100 can be retracted, urging the roller gripper elements 122 axially and radially outward as they translate up the wedge surface 128.

Figure 3:
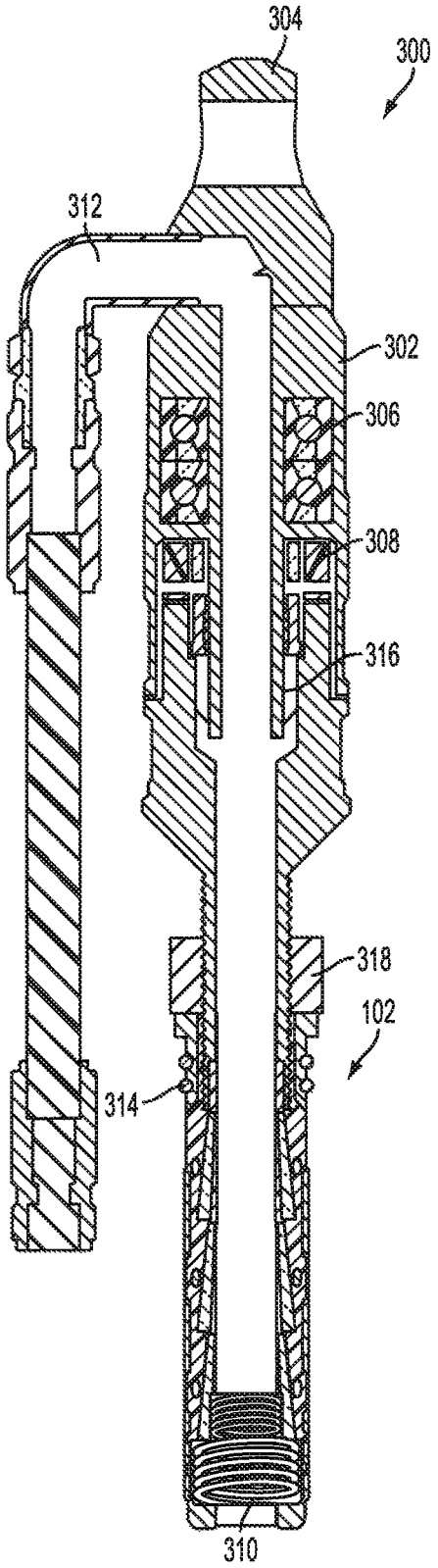
FIG. 3 illustrates a longitudinal cross-sectional view of one example of an aspect of a recovery device configured to function as both a water swivel and a hoist plug.

In other aspects shown in at least FIG. 3, the hoisting device 300 can further comprise a bearing assembly 302 operably disposed between the lifting means 304 and the roller gripper housing 102. In one aspect, bearing assembly 302 can comprise at least one radial bearing 306 operable to allow rotation about the longitudinal axis of the roller gripper housing. In additional or alternative aspects, the bearing assembly 302 can comprise at least one thrust bearing 308 operable to transfer tension between a hoist cable operably associated with the lifting means 304 and a drill string component engaged by the roller gripper housing. In operation, at least one radial bearing 306 can allow rotation needed when the hoisting device comprises a water swivel and at least one thrust bearing 308 can transfer tension between the hoist cable and the at least one drill string component engaged by the roller gripper housing when the hoisting device comprises a hoist plug.

In other aspects, the hoisting device 300 can be configured to supply fluid to or vent fluid from a drill string. Here, the hoisting device further comprises a central bore 310 operable to allow for the passage of fluids and a connection port 312 operably connected to the central bore and configured to facilitate at least one of water supply or fluid venting. In an additional aspect, the roller gripper housing 102 further comprises at least one fluid seal 314 configured to be disposed against a drill string component inner diameter and operable to maintain fluid pressure. In additional or alternative embodiments, a mechanical seal 316 can be disposed between the roller gripper housing and the bearing assembly to ensure a fluid tight seal and to maintain fluid pressure of a fluid disposed therein.

In further aspects, the hoisting device 300 can be configured with dimensions sufficiently small to allow the hoisting device to be fully inserted and lowered into a drill hole to enable recovery of lost drill string components. Here, as one skilled in the art will appreciate in light of the present disclosure, a central bore 310 can allow for rapid decent or ascent through standing fluid.

In other aspects, the hoisting device 300 can further comprise a means to further secure the hoisting device to a drill string component. In one aspect, the means to further secure the hoisting device can be a threaded collar 318.

In other aspects, the hoisting device further comprises a means for lifting the hoisting device. In one aspect, the means for lifting the hoisting device can be a handle configured for manual handling. In another aspect, the means for lifting the hoisting device can comprise a hoisting cable eye. In a further aspect, the hoisting cable eye can be integral with the bearing assembly.

Figure 4:
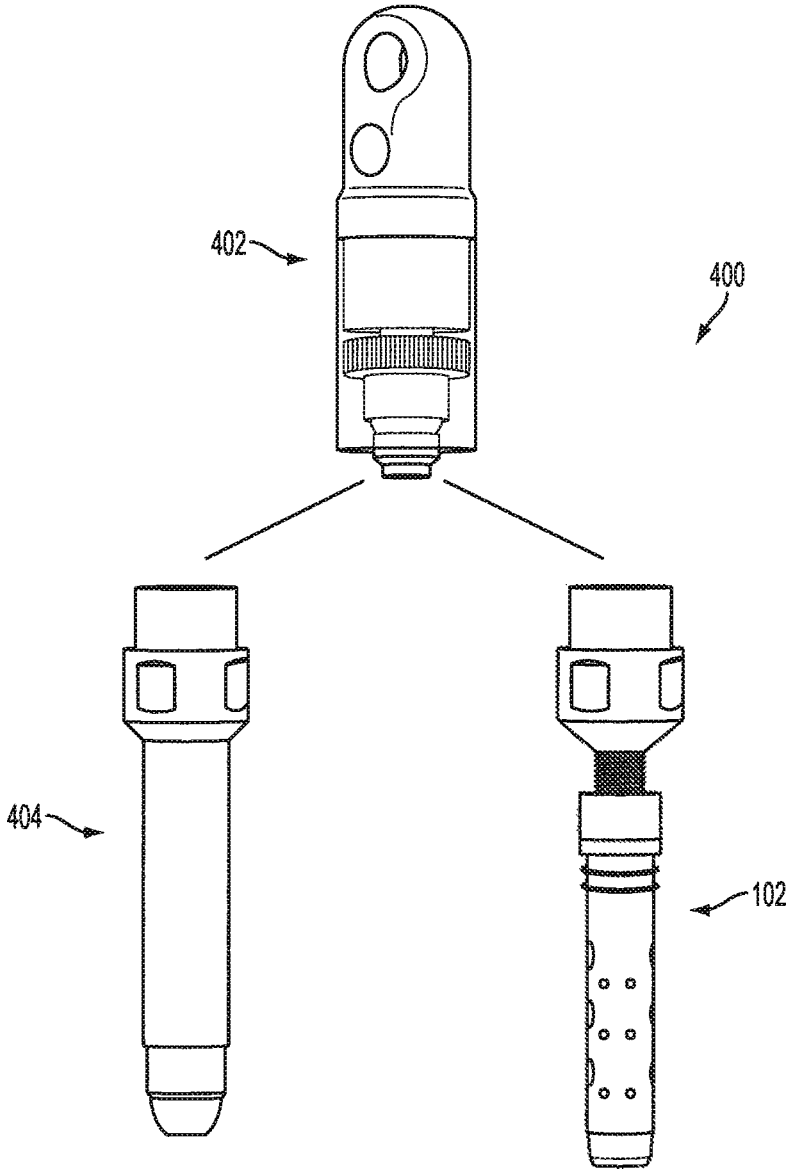
FIG. 4 illustrates a perspective view of one example of a hoisting system having interchangeable attachments.

In yet other aspects illustrated in FIG. 4, a hoisting system 400 is contemplated. Here, a hoist eye and bearing assembly 402 comprise common components for both a water swivel or a hoist plug as described above. The assembly 402 can have interchangeable attachments. In one aspect, the attachment can comprise an extended length threaded adapter 404 configured to enable the drill rig to grip and make or break from the drill string component. The threaded adapter 404 can eliminate the use of wrenches but requires manual thread starting. In another aspect, the attachment can comprise a roller gripper housing 102 as described above. The roller gripper housing can eliminate the need for mating threads and rotation as well as manual wrenches. As one skilled in the art will appreciate, this can lead to lower maintenance requirements and a longer thread wear life for the drill string components.

Figure 5A:
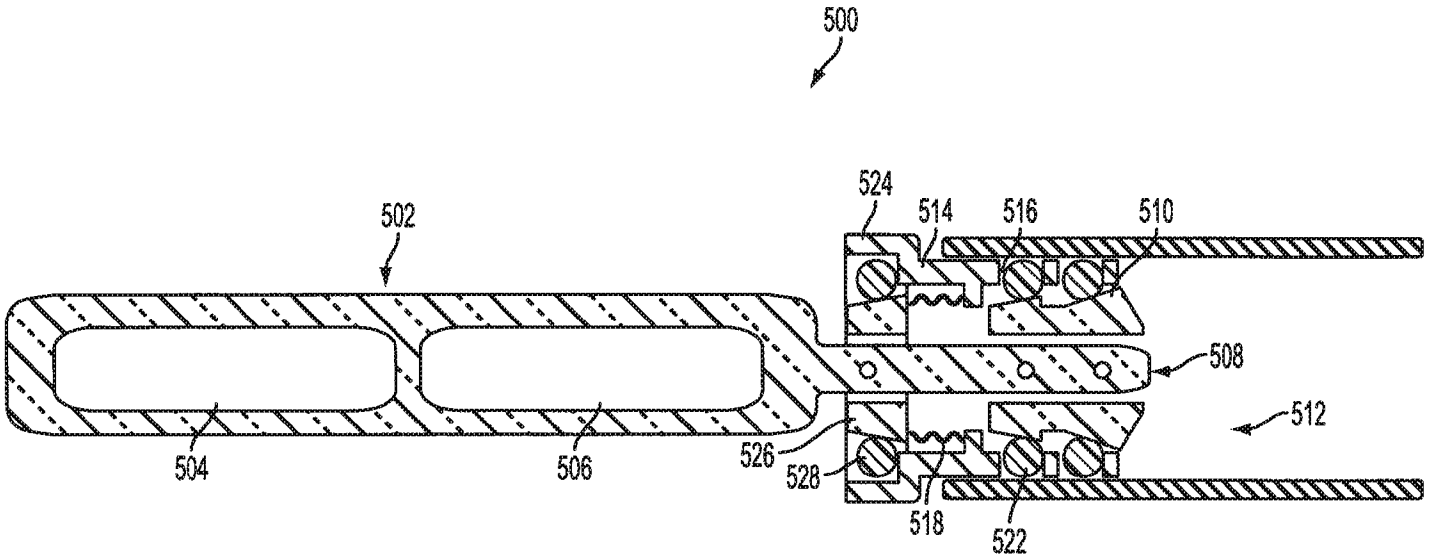
FIG. 5A illustrates a longitudinal cross-sectional view of one example of an aspect of a manual handling device configured to engage an inner diameter of a tubular member.
Figure 5B:
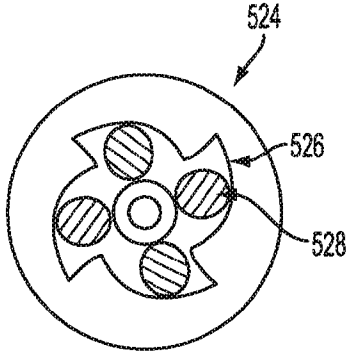
FIG. 5B illustrates a top view of the rotating portion of the manual handling device shown in FIG. 5A.

In one or more other implementations it is contemplated that the hoisting device 500 can be configured for manual handling, coupling and recovery. One exemplary aspect of a manual hoisting device 500 is shown in FIG. 5. In various aspects, manual hoisting devices described herein can be configured to reliable gripping of drill string components regardless of operator position or operator-applied lift. In one aspect, hoisting devices can further comprise an elongated handle 502 to facilitate manual lifting. In this aspect, the handle 502 can be configured for single-handed use and, in a further aspect, can comprise one opening defined therein that is configured to accommodate the operator's hand during a single-handed manual handling operation. In another aspect, the handle 502 can be configured for two-handed use and, in a further aspect, can comprise two openings 504, 506 defined therein that are configured to accommodate each of the operator's hands during a two-handed manual handling operation. In a further aspect, configuring the handle 502 for two-handed use can further comprise selectively changing or, in one example, increasing the length of the handle relative to the elongate length of a handle generally employed for single-handed use. In another aspect, the elongate member can have a second end that can form at least a portion of the base member 508 of a hoisting device. In yet another aspect, the handle 502 can comprise a lightweight material such as, for example and without limitation, aluminum and the like. Use of such a material can reduce repetitive strain injury to the operator that can result from frequent use.

In another aspect, the base member 508 further comprises at least one wedge surface 510 that extends along at least a portion of the axial length of the base member. Wedge surface 510 can be orientated such that the portion of wedge surface 510 with the greatest radial displacement from the central axis of the base member 508 can be positioned closest to the operative end 512 of the hoisting device. In another aspect, cage member 514 can have roller gripper element openings 516 defined therein and can be operatively coupled to the base member by a biasing member 518. The biasing member 518 can be, for example and without limitation, a spring or the like. In a further aspect, the hoisting device can further comprise at least one polar array of roller gripping elements 522 that are positioned axially within the cage member 514 in cooperative communication with roller gripper element openings 516 and, in this aspect, it is also contemplated that the at least one polar array of roller gripper elements can be positioned moveably against at least a portion of at least one wedge surface 510.

In one aspect, in an unloaded position the radial distance across opposing rollers is greater than the inner diameter of the drill string component to be engaged by the hoisting device 500. In operation, as the hoisting device is inserted axially into a drill string component, the roller gripper elements 522 are urged axially and radially inward due to the translation of the roller gripper elements 522 down the corresponding wedge surfaces 510. After the hoisting device engages a desirable axial length of the drill string component, the base member 508 can move relative to the biased cage member 514 in a second axial direction that can be substantially the reverse of the axial insertion direction, urging the roller gripper elements 522 axially and radially outward as the roller gripper elements translate up the corresponding wedged surfaces to an engagement position in which, as described before, the hoisting device will create a secure gripping force on the drill string component and enable handling thereof.

In an optional aspect, the hoisting device 500 can further comprise a cage member 514 having rotating portion 524 defined at or near the end portion of the cage member 514 configured to force the hoisting device to retract axially. Here, the hoisting device 500 can be disengaged from the drill string component by retracting the biased cage 514 to pull the at least one polar array 104 of roller gripper elements 522 from their respective wedged positions. In an alternative aspect, the hoisting device can further comprise a cage member 514 having a disengaging rotating portion 524 defined at or near its end portion 514 that can be configured to force the hoisting device to retract axially to disengage the drill string component. The rotating portion 524 can have an internal, circumferentially orientated plurality of radial wedge surfaces 526 in cooperative communication with a plurality of disengaging polar roller elements 528. The rotating portion 524 of the cage 514 can further comprise at least one circumferential axial wedge surface 526 and can be configured such that the disengaging polar roller elements 528 are also in cooperative communication with the at least one axial wedge surface 530. In operation, as the rotating portion 524 moves in a disengagement direction, the disengaging polar roller elements 528 are urged axially and radially along the radial wedge surfaces 526 and the at least one axial wedge surface such that an axial force can be applied to the cage member 514. As one skilled in the art will appreciate, when the rotating portion 524 is rotated, the hoisting device 500 can force the roller gripping elements 522 from their respective wedged positions, thereby releasing the drill string component from the hoisting device.

Accordingly, FIGS. 1-5, and the corresponding text, provide a number of different components and mechanisms for handling, coupling and recovery of drill string components. In addition to the foregoing, implementations described herein can also be described in terms acts and steps in a method for accomplishing a particular result. For example, a method comprising at least one of handling, coupling and recovering a drill string component is described below with reference to the components and diagrams of FIGS. 1 through 4.

The method can involve engaging a drill string component with an operative end 132 of a hoisting device 100 such that the drill string component forces the self-energizing gripping means to move in an axial and a radial direction to accommodate the engaged diameter of the drill string component to a desired axial length thereof. The method can subsequently involve retracting the hoisting device to cause the self-energizing gripping means to move in the opposite axial and radial directions to create a gripping force capable of securing the drill string component. In a further aspect, the method can include the step of applying force sufficient to retract the self-energizing gripping means from its gripping position to release the drill string component.

Thus, implementations of the foregoing provide various desirable features. For instance, the hoisting devices provided herein can accommodate dimensional changes in the drill string component due to wear and/or loading conditions. In another instance, the self-energizing gripping means provided herein can enable improved gripping capability and reliability as well as reduce damage to drill string components over conventional gripping means.

The present invention can thus be embodied in other specific forms without departing from its spirit or essential characteristics. The described aspects are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A hoisting device, comprising:

a roller gripper housing having a longitudinal axis further comprising:

a cage member having a plurality of roller gripper element openings disposed therein;

a base member having an exterior surface and an elongate length extending between a proximal and a distal end, wherein at least a portion of the exterior surface defines at least one wedge surface that tapers inwardly as the wedge surface moves toward the distal end of the base member; and at least one polar array of roller gripper elements disposed in cooperative communication with the plurality of roller gripper element openings and at least a portion of the at least one wedge surface;

a means for lifting the hoisting device; and a securing means for securing the hoisting device to a drill string component, wherein the securing means comprises a threaded collar.

2. The hoisting device of claim 1, wherein the cage member has a proximal end, and wherein the hoisting device further comprises a spring disposed between the proximal end of the cage member and the base member.

3. The hoisting device of claim 1, wherein the lifting means comprises a handle configured for manually handling the hoisting device.

4. The hoisting device of claim 1, wherein the lifting means comprises a hoisting cable eye.

5. The hoisting device of claim 1, further comprising a bearing assembly operably disposed between the lifting means and the roller gripper housing.

6. The hoisting device of claim 5, wherein the bearing assembly further comprises at least one radial bearing operable to allow rotation about the central axis of the roller gripper housing.

7. The hoisting device of claim 5, wherein the bearing assembly further comprises at least one thrust bearing operable to transfer tension between a hoist cable operably associated with the lifting means and a drill string engaged by the roller gripper housing.

8. The hoisting device of claim 5, further comprising a seal assembly disposed between the roller gripper housing and the bearing assembly.

9. The hoisting device of claim 1, wherein the roller gripper housing comprises a first roller gripper housing, and the securing means further comprises a second roller gripper housing comprising:

a rotating member having a plurality of roller gripper elements disposed therein, a core member having a circumferential length and at least one wedge surface disposed along a portion of the circumferential length operatively coupled to the rotating member, and at least one polar array of roller gripper elements disposed in cooperative communication with the plurality of roller gripper element openings and at least a portion of the at least one wedge surface.

10. The hoisting device of claim 1, further comprising a central bore operable to allow for the passage of fluids.

11. The hoisting device of claim 10, wherein the hoisting device further comprises a connection port operably connected to the central bore and configured to facilitate at least one of water supply or fluid venting.

12. The hoisting device of claim 10, wherein the roller gripper housing further comprises at least one fluid seal configured to be disposed against a drill string component inner diameter.

13. A hoisting device, comprising:

a roller gripper housing having a longitudinal axis further comprising:

a cage member having a plurality of roller gripper element openings disposed therein;

a base member having an exterior surface and an elongate length extending between a proximal and a distal end, wherein at least a portion of the exterior surface defines at least one wedge surface that tapers inwardly as the wedge surface moves toward the distal end of the base member; and at least one polar array of roller gripper elements disposed in cooperative communication with the plurality of roller gripper element openings and at least a portion of the at least one wedge surface;

a lifting means;

a bearing assembly operably disposed between the lifting means and the roller gripper housing; and a securing means for securing the hoisting device to a drill string component, wherein the securing means comprises a threaded collar.

14. The hoisting device of claim 13, wherein the bearing assembly further comprises at least one radial bearing operable to allow rotation about the central axis of the roller gripper housing.

15. The hoisting device of claim 13, wherein the bearing assembly further comprises at least one thrust bearing operable to transfer tension between a hoist cable operably associated with the lifting means and a drill string engaged by the roller gripper housing.

16. The hoisting device of claim 13, wherein the roller gripper housing comprises a first roller gripper housing, and the securing means further comprises a second substantially cylindrical roller gripper housing further comprising:

a second cage member having a plurality of roller gripper elements disposed therein;

a base member having a circumferential length and at least one wedge surface disposed along a portion of the circumferential length operatively coupled to the cage member, and at least one polar array of roller gripper elements disposed in cooperative communication with the plurality of roller gripper element openings and at least a portion of the at least one wedge surface.

17. The hoisting device of claim 13, further comprising a central bore operable to allow for the passage of fluids.

18. The hoisting device of claim 17, wherein the hoisting device further comprises a connection port operably connected to the central bore and configured to facilitate at least one of water supply or fluid venting.

19. The hoisting device of claim 17, wherein the roller gripper housing further comprises at least one fluid seal configured to be disposed against a drill string component inner diameter.

20. A hoisting device, comprising:

a roller gripper housing having a longitudinal axis and further comprising:

a cage member having a plurality of roller gripper element openings disposed therein;

a base member having an exterior surface and an elongate length extending between a proximal and a distal end, wherein at least a portion of the exterior surface defines at least one wedge surface that tapers inwardly as the wedge surface moves toward the distal end of the base member; and at least one polar array of roller gripper elements disposed in cooperative communication with the plurality of roller gripper element openings and at least a portion of the at least one wedge surface; and a means for lifting the hoisting device;

a central bore operable to allow for the passage of fluids; and a connection port operably connected to the central bore and configured to facilitate at least one of water supply or fluid venting.

21. The hoisting device of claim 20, wherein the cage member has a proximal end, the hoisting device further comprising a spring disposed between the proximal end of the cage member and the base member.

22. The hoisting device of claim 20, wherein the lifting means comprises a handle configured for manually handling the apparatus.

23. The hoisting device of claim 20, wherein the lifting means further comprises a hoisting cable eye.

24. The hoisting device of claim 20, further comprising a bearing assembly operably disposed between the lifting means and the roller gripper housing.

25. The hoisting device of claim 24, wherein the bearing assembly further comprises at least one radial bearing operable to allow rotation about the central axis of the roller gripper housing.

26. The hoisting device of claim 24, wherein the bearing assembly further comprises at least one thrust bearing operable to transfer tension between a hoist cable operably associated with the lifting means and a drill string engaged by the roller gripper housing.

27. The hoisting device of claim 24, further comprising a seal assembly disposed between the roller gripper housing and the bearing assembly.

28. The hoisting device of claim 20, further comprising a securing means operable to further secure the apparatus to a drill string component.

29. The hoisting device of claim 28, wherein the securing means comprises a threaded collar.

30. The hoisting device of claim 20, wherein the roller gripper housing further comprises at least one fluid seal configured to be disposed against a drill string component inner diameter.

* * * * *